US005131502A

United States Patent [19]

Sermi

[11] Patent Number: 5,131,502

[45] Date of Patent: Jul. 21, 1992

[54] HOISTING APPARATUS FOR SHIPS

[75] Inventor: Mauri Sermi, Kaarina, Finland

[73] Assignee: MacGregor-Navire (FIN), Finland

[21] Appl. No.: 774,824

[22] Filed: Oct. 11, 1991

[30] Foreign Application Priority Data

Oct. 11, 1990 [FI] Finland ..... 905009

[51] Int. Cl.[5] ..... B66B 9/06

[52] U.S. Cl. ..... 187/14; 187/12; 114/72; 414/137.1; 414/143.2; 414/595

[58] Field of Search ..... 187/12, 13, 14; 114/72; 414/592, 595, 596, 597, 143.2, 137.1

[56] References Cited

U.S. PATENT DOCUMENTS 3,207,329 9/1965 Bevard ..... 414/143.2
3,517,775 6/1970 Meyer .
4,355,805 6/1982 Grass ..... 187/12

FOREIGN PATENT DOCUMENTS 229486 10/1909 Fed. Rep. of Germany .

*Primary Examiner*—Robert P. Olszewski
*Assistant Examiner*—Dean A. Reichard
*Attorney, Agent, or Firm*—Sughrue, Mion, Zinn, Macpeak & Seas

[57] ABSTRACT

Hoisting apparatus, comprising a side loader, passenger or freight elevator for ships, having a cage which moves along a path at least partially curved. The hoisting apparatus include an elevator shaft mounted on the ship broadside provided with one or more guide rails along which the side loader cage can be moved. The hoisting apparatus comprises at least a hoisting machine, hoisting ropes, elements moving along the guide rail or guide rails, and a lifting platform. To ensure that the lifting platform remains essentially parallel to the ship deck throughout the travel of the lifting platform, the hoisting apparatus comprises a control rail placed beside the guide rail or between the guide rails, a stabilizing element attached at one end to the lifting platform and essentially immovable relative to the lifting platform, the other end of said element running along the control rail during the motion of the cage, and a carriage placed between the stabilizing element and the lifting platform, the stabilizing element being provided with bearings allowing rotation of the carriage relative to the stabilizing element and lifting platform.

8 Claims, 6 Drawing Sheets

HOISTING APPARATUS FOR SHIPS

BACKGROUND OF THE INVENTION

1. Field of the Invention

The present invention relates to a hoisting apparatus for ships, comprising a side loader, freight or passenger elevator. The cage of the hoisting apparatus moves along a path arranged on a ship broadside. The path is formed in an elevator shaft, is at least partially curved and provided with one or more guide rails on which the side loader cage can travel. The hoisting apparatus further comprises at least a hoisting machine, hoisting ropes, elements moving along the guide rails and a lifting platform.

2. Brief Description of the Prior Art

Side loaders, as the name suggests, are placed on a ship near its side and used to move loads into or out of the ship. The loads are generally transferred to and from the side loader by means of fork-lift trucks. The cargo space usually comprises several floors, each provided with its own fork-lift truck. Similarly, fork-lift trucks are used outside the ship to transport the loads on the shore. The side loader cage currently used move along a straight path. They may move along a vertical or an oblique path, but the path is substantially straight, i.e. no change of direction of the side loader travel occurs.

Vertical side loaders are generally used in ships whose broadsides are essentially vertical. However, refrigerating cargo ships become more and more common since in order to reduce the water resistance and thus to increase the speed, the ship's sides are designed at least partially curved. More specifically, the broadside of a ship is substantially straight in its upper part but bends inwards around the middle of the side. These types of ships are usually provided with a side loader cage running along an oblique path as mentioned above. However, since the path is still straight, this solution is not optimal in the utilization of space. Thus, there is a need to develop a side loader having a cage which moves along a path that follows the shape of the broadside of the ship. However, a problem associated with such a side loader is the need to ensure that the lifting platform remains oriented in a direction parallel to the ship deck during travel, which in practice means keeping it horizontal.

SUMMARY OF THE INVENTION

The object of the present invention is to achieve a hoisting apparatus comprising a cage which moves along a path at least partially curved and which has a lifting platform that remains substantially parallel to the ship deck all the time regardless of the position of the load on the platform.

Accordingly, a hoisting apparatus for transporting passengers and loads arranged substantially along a broadside of a ship, comprises: a) an elevator shaft providing a path having a curved portion and straight portions, along which a side loader cage travels up and down transporting loads; b) at least one guide rail provided in said elevator shaft, directing the travel of said cage; c) at least a hoisting machine located at the upper part of said elevator shaft, lifting said cage by use of hoisting ropes attached thereto; d) a control element placed besides and along said at least one guide rail controlling the travel of said cage; e) guiding elements running along said at least one guide rail laterally supporting and guiding said cage during travel; f) said cage travelling up and down in said elevator shaft comprising: a lifting platform adapted to transport loads in the elevator shaft from a loading point to a desired ship deck; a stabilizing element fixed on said lifting platform with one end, in an essentially immovable relative position, the other end of said stabilizing element being adapted to run along said control element during the travel of said cage; and a carriage placed between the stabilizing element and the lifting platform, and means for changing the position of said carriage relative to said lifting platform; during said cage run, wherein said stabilizing element is provided with bearings allowing rotation relative to said carriage, so that the lifting platform remains essentially parallel to the ship deck throughout the travel of said cage.

The invention has the advantage that, e.g. in refrigerator ships and small ships with a relatively small cargo space, the side loader can be placed in a more appropriate manner that allows a more efficient use of space than before. Therefore, the placement of the hoisting device on the ship is not dependent on the shape of the ship sides below the floating line but can instead be optimized according to the cargo space or other design parameters. At the same time, the invention provides a possibility to place another hoisting apparatus, e.g. an elevator for passengers or goods, in a way other than the traditional.

BRIEF DESCRIPTION OF THE DRAWINGS

In the following, the invention is described in detail by the aid of examples, referring to the drawings attached in which.

DESCRIPTION OF THE PREFERRED EMBODIMENT

Figure 1:
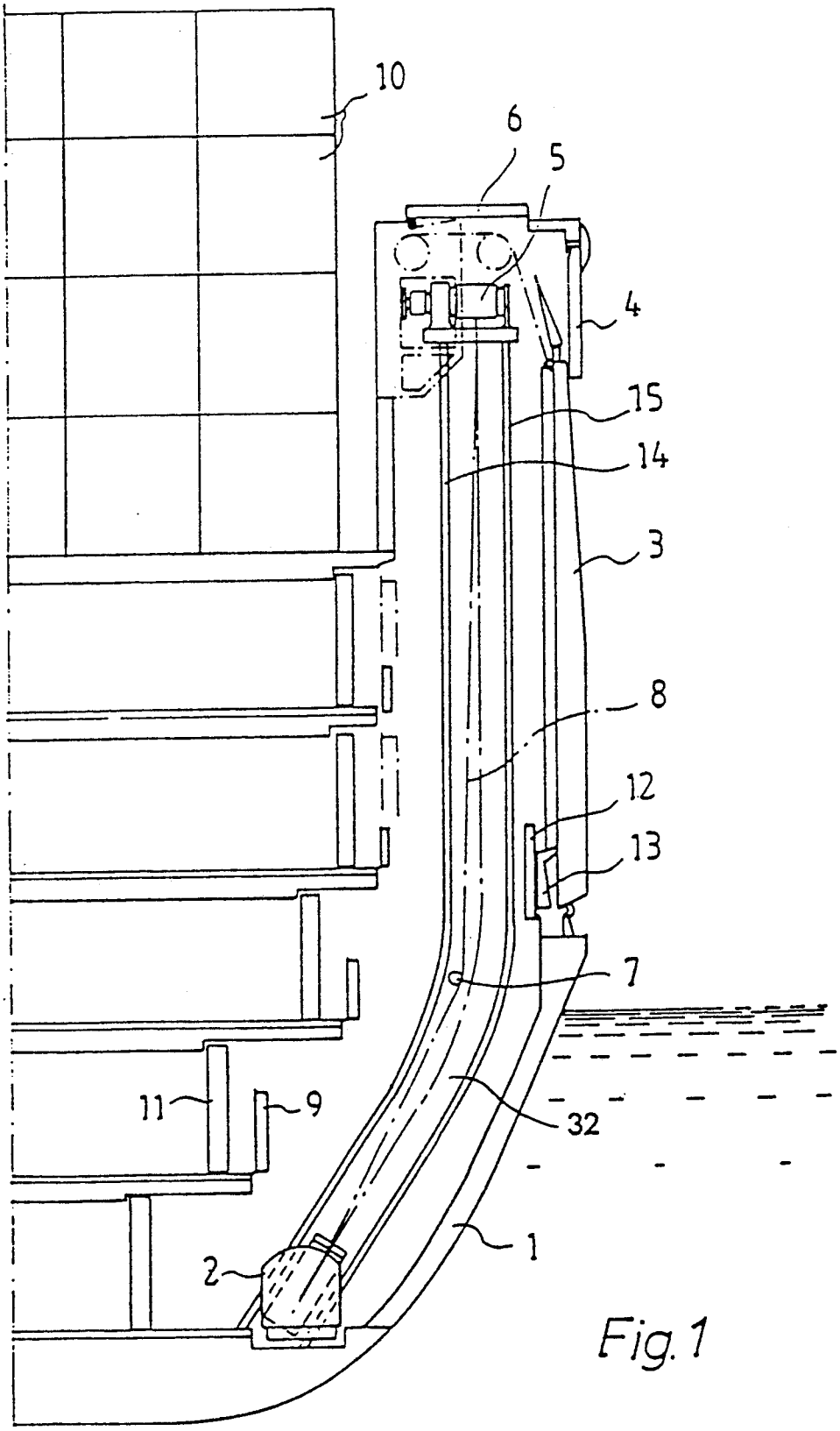
FIG. 1 illustrates a partial vertical cross-section in a ship provided with a hoisting apparatus according to the invention.

FIG. 1 shows ship broadside 1 which has an inward curvature below the floating line to reduce the water resistance. The ship is provided with a cage 2 according to the invention, which moves along a path partially curved. In the situation illustrated by FIG. 1, the cage is in its lower position in a recess reserved for it. This is the situation when the ship is in motion and the side gate 3 is in its vertical position, i.e. closed. In this situation, a side wicket 4 provided in the upper part of the side gate stays turned over the gate. The cage is displaced by use of a hoisting machine 5, which is placed at the upper part of an elevator shaft 32 under a hinged top cover 6.

The cage represented in FIG. 1 travels along two guide rails 14, 15 and is actuated by hoisting ropes 8 extending from the hoisting machine to the cage. Several ropes placed side by side can be used.

The cargo space of the ship is divided into several floors. At the entrance of each floor is a turnable side wicket 9 allowing a fork-lift truck to transfer goods from/to the side loader. In the situation illustrated in FIG. 1, the side wickets are in their vertical position. In addition, each floor is provided with an openable inner door 11. Moreover, a cargo ship like this can carry containers 10 on its deck as illustrated in FIG. 1.

Figure 2:
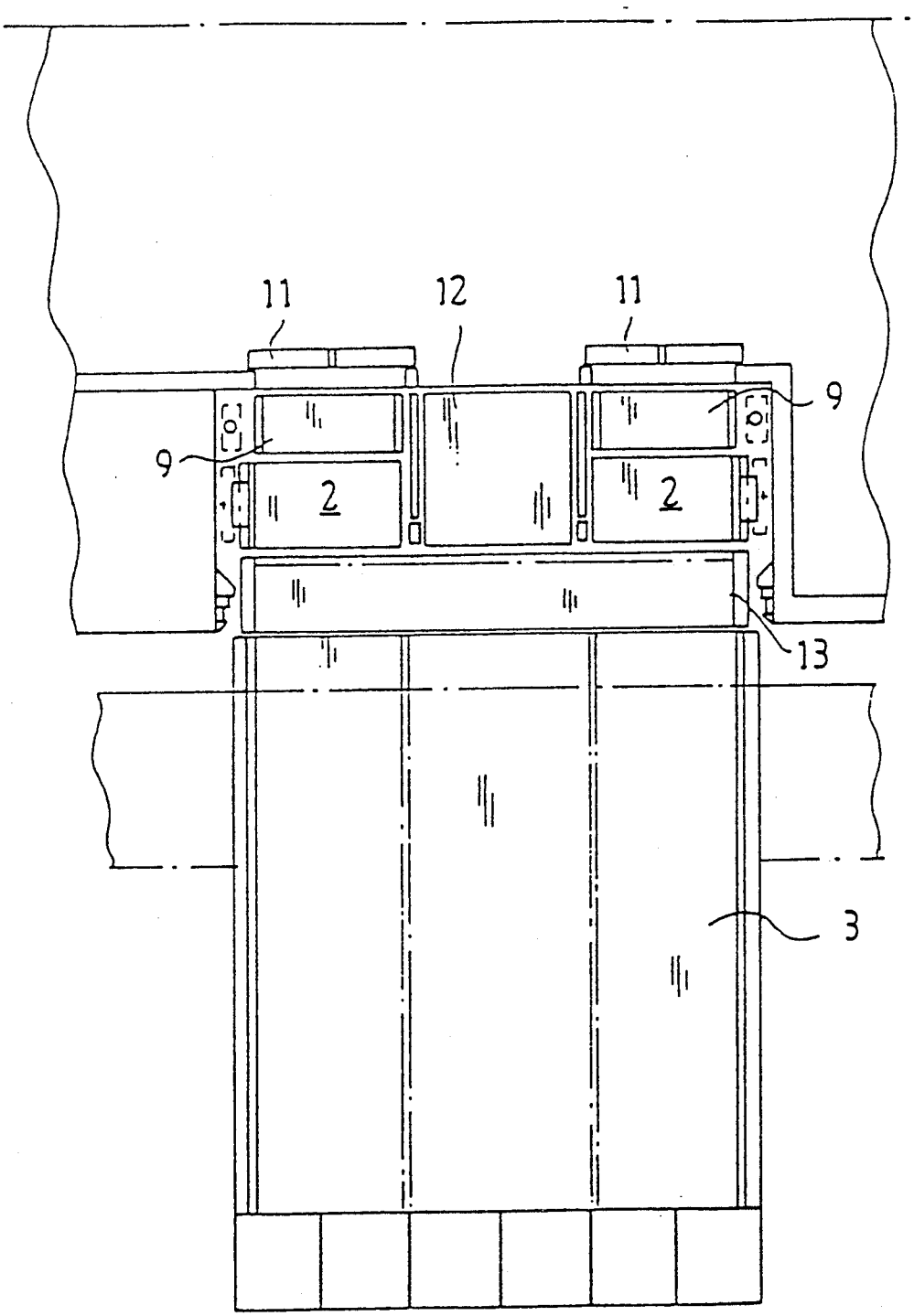
FIG. 2 illustrates a top view of the hoisting apparatus and the ship with the side gate ramp and wickets opened for transferring the load.

FIG. 2 shows a top view of a hoisting apparatus for ships where the side gate 3, side wickets 9, intermediate wicket 12 and ramp 13 have been turned down into the loading and unloading position. In addition, two cages 2, i.e. are represented in their high position. The side loaders can naturally work independently of each other, each having its own hoisting machine.

Figure 3:
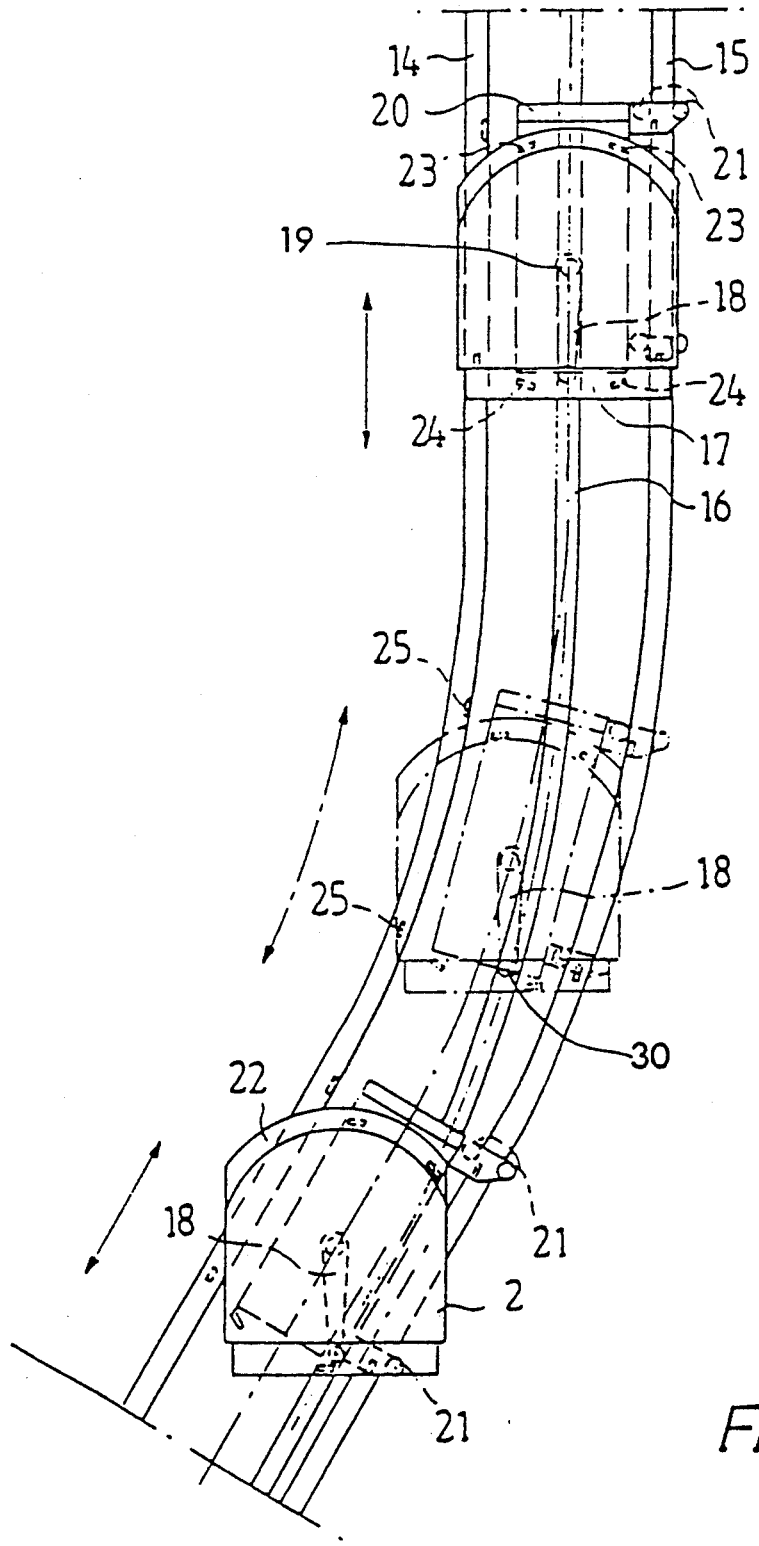
FIG. 3 illustrates the curved path of the hoisting device and an embodiment of the cage in three different locations during its travel.
Figure 4:
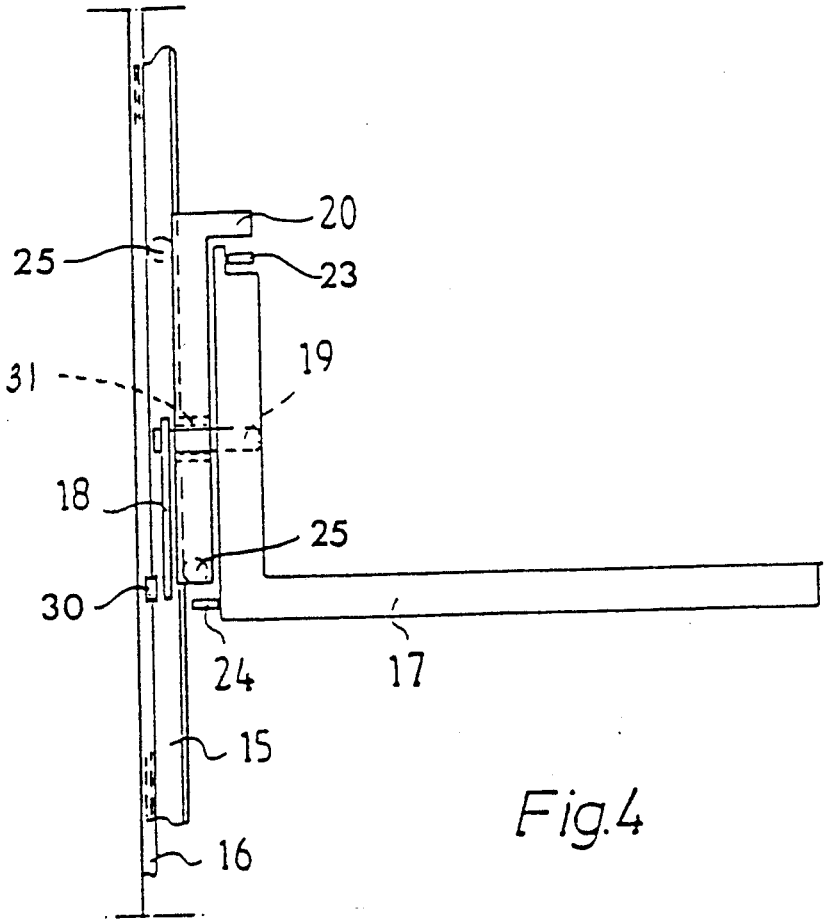
FIG. 4 illustrates a lateral view of an embodiment of the cage of the invention.
Figure 5:
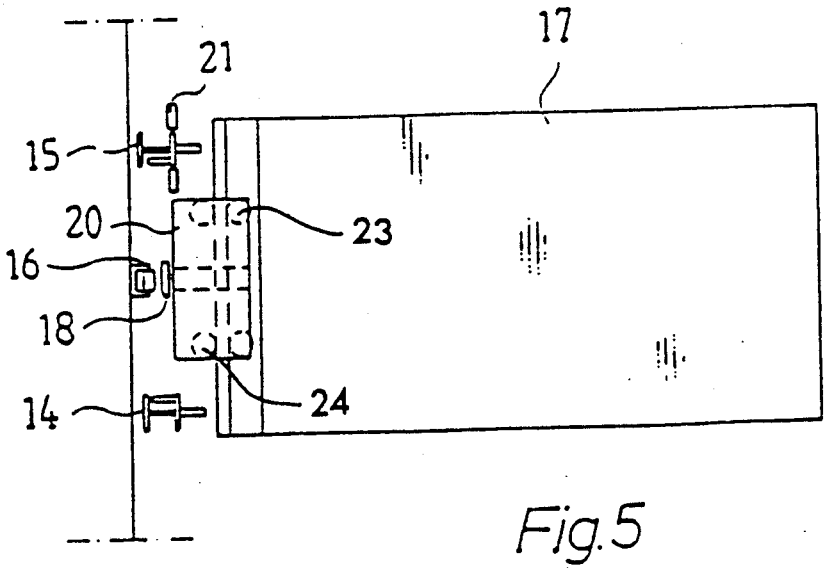
FIG. 5 shows a top view of the embodiment of FIG. 4.

An essential feature of the invention is that the cage moves along a path at least partially curved, following the shape of the ship's broadside as illustrated by FIG. 3. This figure presents an embodiment of the cage in three different locations along its path. In this embodiment, the hoisting apparatus comprises two parallel guide rails 14 and 15 and a control element 16 placed between them. The cage comprises a lifting platform 17 shown in FIGS. 4 and 5. The platform 17 has an L-shaped cross-section, comprising a horizontal part on which the load rests and a vertical part. The vertical part of the lifting platform is provided with a stabilizing element comprising stabilizing lever 18 which is attached substantially in the middle of the vertical part of the lifting platform by means of a horizontal pin 19. The other end of the stabilizing lever is attached to the control rail 16 with attachment 30 in a manner allowing it to move freely along the rail. The stabilizing lever 18 and the lifting platform 17 do not move relative to each other. Provided between the stabilizing lever 18 and the vertical part of the lifting platform 17 is a carriage 20 mounted to rotate about the pin 19 by use of a bearing arrangement 31. The upper and lower ends of the carriage are provided with sliding elements, in this embodiment wheels 21 engaging guide rail 15 on its two lateral sides, to guide the carriage travel from the lateral side. Mounted on the other side of the carriage 20 are simple wheels 25 or sliding elements which slide along guide rail 14. In some particular embodiments it is possible to leave out guide rail 14 and wheels 25 if sufficient support for the carriage is provided by wheels 21.

As shown in FIG. 3, the upper edge of the vertical part of the lifting platform is provided with a curved recess 22 in which wheels mounted on the carriage 20 move when the position of the carriage relative to the lifting platform changes. Mounted on the lower edge of the carriage are wheels 24 which touch the lower edge of the vertical part of the lifting platform. The function of wheels 23 and 24 is to support the lifting platform against the torsion generated by the load on the platform.

As can be seen from FIG. 3 at the straight upper part of the path of the side loader, the control rail 16 runs essentially in the middle between the guide rails 14 and 15. The curvature of the control rail starts at about the same point as that of the guide rails but it has a larger radius so that after the curved portion the control rail is located near guide rail 15. Along the lower straight portion of the path (i.e. after the curvature), the control rail 16 is again essentially parallel to the guide rails 14, 15.

The hoisting apparatus works as follows: In the uppermost position represented on FIG. 3, the cage is within the straight portion on the path, in which case the carriage 20 is in a vertical position. The stabilizing lever 18 lies essentially parallel to the guide rails. When the guide rails 14, 15 become curved, the carriage 20 follows guide rail 15 because it is guided on it by wheels 21. The carriage 20 assumes thus an oblique position (see the middle position) as it is provided with bearing arrangement 31, allowing the rotation around pin 19. The stabilizing lever remains essentially vertical because its lower end is guided by attachment 30, moving along the control rail 16, which has a curvature radius bigger than the radius of guide rail 15. Since the stabilizing lever 18 and the lifting platform 17 are fixed together, the lifting platform is also maintained in a horizontal position (more precisely the horizontal part of the lifting platform is held parallel to the ship deck). The curvature of the guide and control rails, length of the stabilizing lever as well as dimensions of the elements can be determined by a person skilled in the art for obtaining a position of platform 17 always parallel with the ship deck. This dimensioning depends on the radius of curvature of the guide rails, among other design data.

Figure 6:
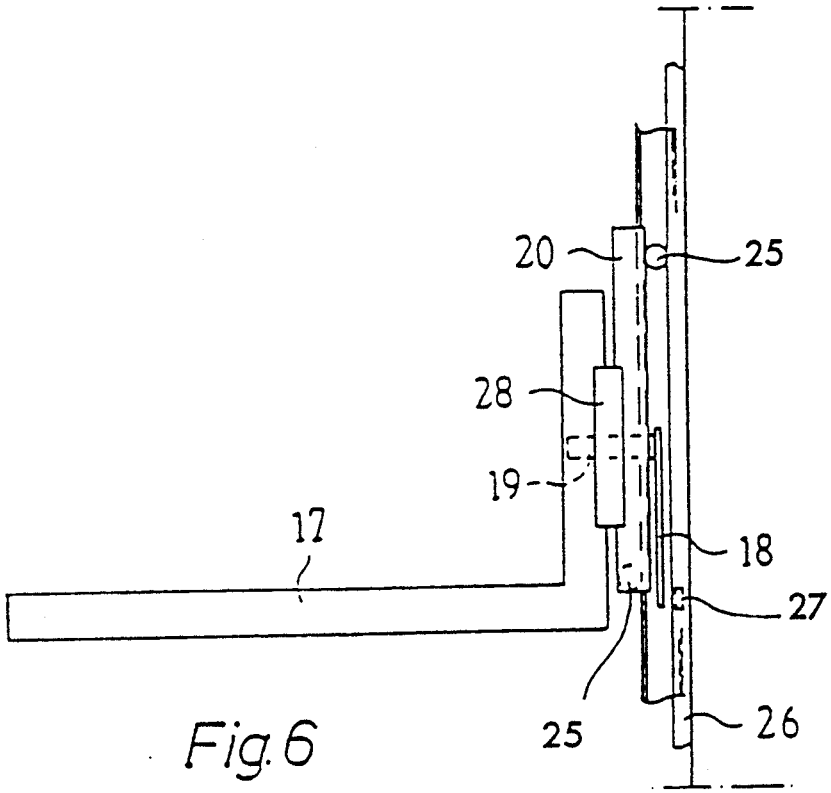
FIG. 6 illustrates a lateral view of another embodiment of the cage of the invention.
Figure 7:
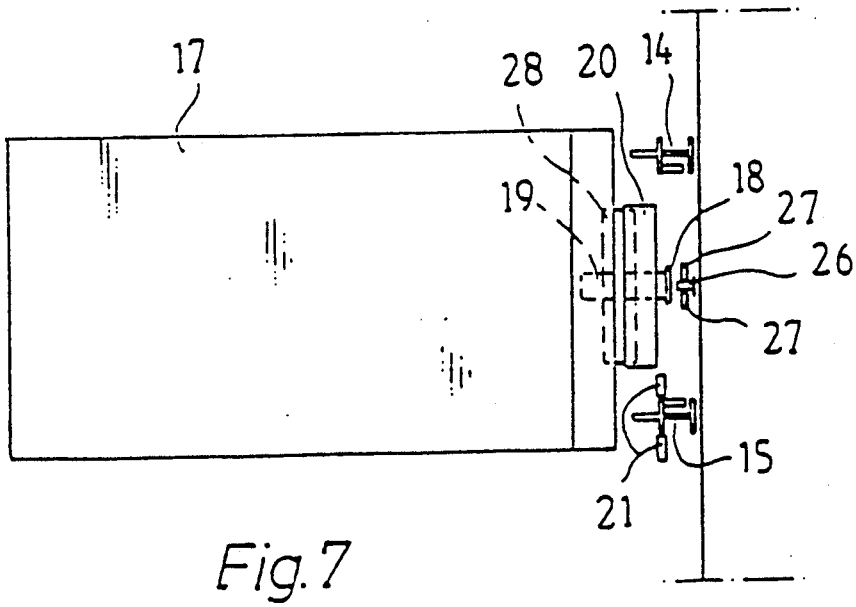
FIG. 7 shows a top view of the embodiment of FIG. 6.
Figure 8:
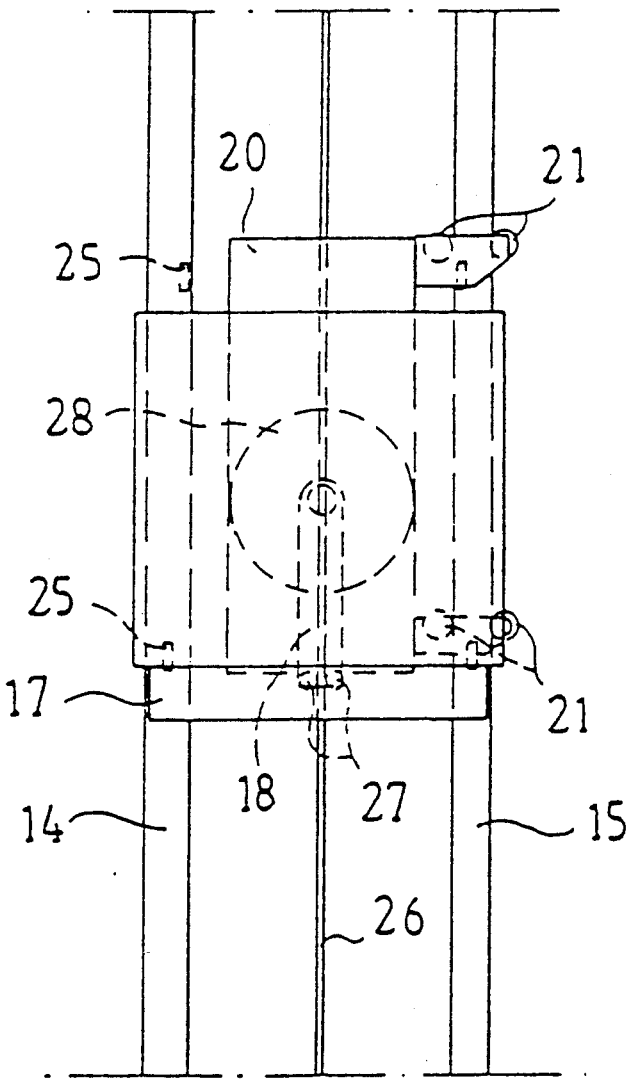
FIG. 8 shows a front view of the embodiment of FIG. 6.

Instead of a control rail, it is possible to use a simple strip 26, in which case the stabilizing lever structure sliding along the strip is constructed accordingly. The differences as compared with the embodiment described above can be seen on FIGS. 6–8. The stabilizing lever may be provided e.g. with adjacent wheels 27 or sliding pieces running on opposite sides of the control strip in place of the attachment 30. In this embodiment, presented in FIGS. 6–8, the bearing arrangement between the carriage and lifting platform is different from that of the embodiment of FIGS. 3–5 (i.e. 31 in FIG. 4). Instead of curved recess 22, the embodiment is provided with a bearing element 28 which is partially imbedded in the carriage 20 and the vertical part of the lifting platform 17. This allows the lifting platform to turn relative to the carriage exactly in the desired manner. In other respects, the operating principle of a hoisting apparatus like this is as described above.

As stated above, FIG. 1 shows the hoisting ropes of the hoisting apparatus, with reference number 8. Since the cage runs along a curved track, the hoisting ropes would touch guide rail 14 or some other structure of the side loader in the region of the curvature when the lifting platform is in the low position or close to it. To prevent this, the apparatus is provided with a diverting pulley 7 mounted close to guide rail 14 at a point in the curved portion, to guide the hoisting ropes on a suitable free track. Placed in the same region is a spring element (not shown in the figures) which presses the hoisting ropes against the diverting pulley. This ensures that the ropes will remain tightly pressed against the pulley even when they are temporarily slackened, e.g. when the cage is in its rest position shown in FIG. 1. The diverting pulley 7 is so placed as to ensure free passage for the carriage of the cage. The spring element pressing the ropes against the pulley is also so designed that it allows the ropes to come clear of the diverting pulley as the cage travels above it.

It is obvious to a person skilled in the art that different embodiments of the invention are not restricted to the examples described above, but that they may instead be varied within the scope of the following claims. The hoisting apparatus of the invention can just as well be used as a passenger or freight elevator or equivalent in a ship, and it is not necessarily to place it by the broadside. In the embodiments described above, the control rail or strip is essentially in the middle between the guide rails in the upper part of the path of the lifting platform. However, it is possible to place the control rail in some other way if the direction or fixing point of the stabilizing lever is accordingly changed. Regarding the techniques of manufacture and installation, the control rail or strip and the guide rail(s), or at least the curved portions thereof, should be preferably manufactured beforehand in a factory as a single assembly which is then installed on the ship.

Furthermore, it is to be noted that, instead of a stabilizing lever, it is possible to use other structures for the same purpose. The essential point is that there should be some sort of connection between the lifting platform and the control rail or strip and that the carriage be guided in the lateral direction by at least one guide rail.

I claim:

1. A hoisting apparatus for transporting passengers and loads arranged substantially along a broadside of a ship, comprising:

a) an elevator shaft providing a path having a curved portion and straight portions, along which a side loader cage travels up and down transporting loads;

b) at least one guide rail provided in said elevator shaft, directing the travel of said cage;

c) at least a hoisting machine located at the upper part of said elevator shaft, lifting said cage by use of hoisting ropes attached thereto;

d) a control element placed beside and along said at least one guide rail controlling the travel of said cage;

e) guiding elements running along said at least one guide rail laterally supporting and guiding said cage during travel;

f) said cage, travelling up and down in said elevator shaft comprising: a lifting platform adapted to transport loads in the elevator shaft from a loading point to a desired ship deck;

a stabilizing element fixed on said lifting platform with one end, in an essentially immovable relative position, the other end of said stabilizing element being adapted to run along said control element during the travel of said cage; and a carriage placed between the stabilizing element and the lifting platform, and means for changing the position of said carriage relative to said lifting platform during the travel of said cage, wherein said stabilizing element is provided with bearings allowing its rotation relative to said carriage, so that the lifting platform remains essentially parallel to the ship deck throughout the travel of said cage.

2. A hoisting apparatus according to claim 1, wherein the stabilizing element comprises a stabilizing lever and a pin, wherein said pin is fixed with one end at the upper end of said stabilizing lever; extends through the carriage, which is rotatably mounted about said pin; and is fixed with the other end to a vertical part of said lifting platform.

3. A hoisting apparatus according to claim 1, wherein said guiding elements designed to laterally guide the travel of said cage along the guide rail are mounted on said carriage.

4. A hoisting apparatus according to claim 1, wherein said control element comprises an essentially continuous control rail, wherein in the curved portion of the path of said side loader the radius of curvature of said control rail exceeds the radius of curvature of said at least one guide rail; and in the straight portions of the path of said side loader said control rail is parallel to said at least one guide rail.

5. A hoisting apparatus according to claim 1, wherein said control element comprises an essentially continuous control strip, wherein in the curved portion of the path of said side loader the radius of curvature of said control strip exceeds the radius of curvature of said at least one guide rail; and in the straight portions of the path of said side loader said control strip is parallel to said at least one guide rail.

6. A hoisting apparatus according to claim 1, wherein said means for changing the position of said carriage relative to the lifting platform about its horizontal axis during said cage run comprises: a curved recess manufactured on the upper edge of a vertical part of said lifting platform; first wheels or sliding elements arranged at the upper end of said carriage, running in said curved recess; and second wheels or sliding elements arranged at the lower end of said carriage, running at the lower edge of said vertical part of said lifting platform.

7. A hoisting apparatus according to claim 1, wherein said means for changing the position of the carriage relative to the lifting platform comprises a circular bearing arrangement which allows the positions of the lifting platform and the carriage to change relative to each other about a horizontal axis.

8. A hoisting apparatus according to claim 1, wherein said hoisting ropes are attached to the upper part of said carriage, and when the lifting platform travels below the curved portion of said path, said ropes engage a diverting pulley, mounted in said elevator shaft at a location in the curved portion of the path, diverting the hoisting ropes from touching the guide rail or structures in the vicinity of said path of said side loader.

* * * * *